US007102506B2

(12) United States Patent
Szulanski

(10) Patent No.: US 7,102,506 B2
(45) Date of Patent: Sep. 5, 2006

(54) MEANS ARRANGEMENT CAPABLE OF SELECTING AND SIGNAL A PUBLIC TRANSPORTATION MEANS TO STOP AT ITS STOPPING PLACE, AND TO DETECT SAID STOPPING PLACE OF SAID TRANSPORTATION MEANS, PARTICULARLY APT TO BE USED BY HANDICAPPED PEOPLE, MORE PARTICULARLY STILL, BY PEOPLE WITH VISUAL INCAPACITIES

(76) Inventor: Sergio Oscar Szulanski, Zapiol 1989 5 "A", Buenos Aires, Capital Federal (AR), 1428

( * ) Notice: Subject to any disclaimer, the term of this patent is extended or adjusted under 35 U.S.C. 154(b) by 157 days.

(21) Appl. No.: 10/403,082

(22) Filed: Apr. 1, 2003

(65) Prior Publication Data

US 2004/0066315 A1 Apr. 8, 2004

(30) Foreign Application Priority Data

Sep. 24, 2002 (AR) ..... P020103579

(51) Int. Cl.
*G08B 1/08* (2006.01)

(52) U.S. Cl. ..... 340/539.11; 340/573.1; 340/994; 340/10.1

(58) Field of Classification Search ..... 340/539.11, 340/573.1, 825.19, 994, 988, 309.16, 10.1, 340/502, 7.6, 7.62, 407.1, 384.1; 455/39
See application file for complete search history.

(56) References Cited

U.S. PATENT DOCUMENTS 5,774,072 A * 6/1998 Wu ..... 340/994
6,355,989 B1 * 3/2002 Westcott ..... 307/10.1
6,374,176 B1 * 4/2002 Schmier et al. ..... 701/200
6,621,177 B1 * 9/2003 Westcott ..... 307/10.1
6,763,299 B1 * 7/2004 Jones ..... 701/201

* cited by examiner

*Primary Examiner*—Phung Nguyen
(74) *Attorney, Agent, or Firm*—Andrew Wilford

(57) ABSTRACT

In a city wherein the public transportation network is served by several different transportation lines, the visually handicapped persons wishing to accede to a transportation means belonging to a determined transportation line encounters difficulties in locating and arriving to said bus stop, to determine when the required vehicle is approaching and how to signal the driver to let him know in anticipation that the person who is about to embark is suffering from a disability, in order to allow said driver to consider taking the necessary care and precautions. The system uses a device held by each user who needs it, by a device in each bus stop and a device in each vehicle, it is possible to solve the above said problem, exchanging between said three devices five linking signals, of a limited reach. The frequency and other attributes of each one of said signals are one and only one for each transportation line, and as well as for the circulation direction, for each line.

12 Claims, 2 Drawing Sheets

MEANS ARRANGEMENT CAPABLE OF SELECTING AND SIGNAL A PUBLIC TRANSPORTATION MEANS TO STOP AT ITS STOPPING PLACE, AND TO DETECT SAID STOPPING PLACE OF SAID TRANSPORTATION MEANS, PARTICULARLY APT TO BE USED BY HANDICAPPED PEOPLE, MORE PARTICULARLY STILL, BY PEOPLE WITH VISUAL INCAPACITIES

FIELD OF THE INVENTION

The present invention deals with the selection and the issue of a stop request for public transportation, and the detection of the stopping place particularly for use by visually impaired people, or people with a physical disability.

BACKGROUND OF THE INVENTION

It is known that for people suffering from physical disabilities, the use of public transportation facilities ("the bus") entails inconveniences which adds to their dysfunction, since they must be able to recognize the place of detention of the public transportation facility the "bus stop") and once there, to be able to signal said bus to stop, clearly signalling to its driver that the caller is a handicapped person, in order to allow the driver to take the necessary precautions and care, such as correct parking, properly positioning the bus and to be prepared to allow for a longer than usual stopping time, with the eventual attention to the impaired passenger.

Even if in this specification the term "bus stop" and "bus" are employed, their use encompasses all and every other kind of public transportation, such as tramways, city cabs, or the like.

For physically impaired people, including people with poor eyesight, such as people suffering from myopia, cataracts, etc, or for people suffering total blindness, to the above mentioned inconveniences it must be added the complexities derived from their particular conditions, since the people with poor vision or no vision at all, once they are able to recognize and reach the determined bus stop, and once they somehow are capable to signal to said bus to stop, they cannot know when the bus has detected their call, and cannot receive any acknowledgement from the bus driver, and even less are they able to know when said bus is approaching or stopping. Moreover, if the bus stop accommodates more than one bus line, they cannot know if the bus that has stopped is the one they intend to take.

In fact, even if the person interested in boarding the bus has limited eyesight, it takes some people considerable time to be able to identify the particular line bus they intend to board, particularly people of old age.

It is, therefore, important to allow handicapped people, even people with problems in their eyes, to detect their selected bus stop, to reach said bus stop, to call or signal the particular bus they intend to take, and to be sure the driver of this particular bus will stop for them at the bus stop.

Devices which issue a signal, such as a radio link signal, and audible signal, a sensorial or luminous signal, are elements well known in the art, as are the means capable of receiving said signals. In particular, the electronic means capable of issuing a link signal of a determined frequency, and to receive and store it, are well known in the art.

A particular example of the latter is given by radio signals capable of being received by a receiver set. A characteristic example of such radio signal transmitters is given by some known constructions which allows the emission of a radio signal of a determined frequency, either from a fixed location or from a moving location, such as a moving vehicle, and whereby in answer to said signal, the traffic lights change accordingly to "green", thus allowing free way for an ambulance, fire fighting vehicle or police vehicles to advance without being detained by red lights. Other constructions are use these signals to open or close garage doors, etc.

In all these know devices, the link signal producing the desired effect has one or more particular attributes in order to allow the receiving means to distinguish these signals from other signals, emitted by other means, with or without similar purposes, or including, signals issued upon intrusion or disturbance.

Also, the attribute or attributes allows the receiving means to interpret the order sent by the operator when this operator has at its end several options or indications.

These attributes can be:

a) The frequency of a continuous link signal (this system is quite economical, but is vulnerable.

b) The frequency of a modulated link signal, with analog or digital modulation or codification.

c) The modulating signal (analog or digital) of a series of linking signals having the same frequency of the carrier signal.

To the ends of this instant patent, no distinction will be made between any of the above mentioned ways to introduce attributes to the link signal, considering all of them as equivalent signal codification means. This is so, even if in the following constructions it is described only one of the possible ways to attain these results.

Also, in the following description neither will any distinction be made between the link means, such as radio frequency in its several wavelengths, infrared signals, microwave, etc.

When in one of the devices forming part of this instant invention it is necessary to receive more than one link signal, such as in the case of the hand-held device used by the handicapped person or user, ("user's portable means") it will be mentioned that it has more than one receiving set, but it must be understood this is true only for cases mentioned under a) and b).

When dealing with case c) it will be understood that there is a single receiver set, but immediately after it is a separator stage of the several link signals, (for instance, a demultiplexing circuit), which have the same carrier wave but different modulations.

Similarly, if one of the devices is capable to emit more than one signal, it will be mentioned as having more than one sending or emission set, but this can be only true for the cases mentioned under a) or b), and even in these cases it could be that physically there is only one sending device or emitting set, capable of changing its frequency according to the signal to be sent, but in the case listed under c), there is only one emitting set.

Also, when it is mentioned that a signal is being sent or received of a determined frequency, if we are dealing with the case listed under c) it must be interpreted the signal emitted or received has at least one attribute pertaining to a signal having a fixed frequency.

Similarly, when making use of more than one receiver or emission set, the same antennae can be shared between these devices, if the frequency of the sending or received signal falls within the same wave length band, or their frequency are close to one another.

A large city is served by a plurality of public transportation lines or services. Hence a given stopping place may be shared by several transportation lines, in order to allow for the orderly embarkation and disembarkation of the passengers. Moreover, in a large city with several millions of inhabitants, it is usual that in a certain block there can be two or three of said bus of tramway stops. Therefore, in a given length of 200 meters, an average of 24 different bus lines can be served, as it is specifically the case of a large city as Buenos Aires.

A handicapped person, who has his its vision impaired or lessened, may only recognize the several and different bus stops when he practically stumbles upon said bus stops, while the actual transportation means (e.g., the buses) can be recognized and classified at a very short distance. This can lead to peculiar cases of social behavior, and in the case of persons who have a particularly poor vision, such as elderly people, it may lead to self-social exclusion, or social segregation. Now, when considering people who have completely lost their vision, ("blind people"), these problems are of course compounded, since a blind person can now only recognize a bus strop by continuously asking other people, or by reading the Braille cards attached to determined bus stop, such as the poles or similar landmarks identifying said bus stops, when and if said cards are supplied and affixed, of course providing he could find the bus stop in the first place. As a rule, in cities or parts of the city in which said cards are not supplied to said bus stops, blind people encounter really great problems in accessing public transportation, and as a result they must endure large delays, unless accompanied by an able person.

Inevitably this leads to a loss of independence for visually impaired people living within the limits of a large city, converting these handicapped people into socially dependant persons. It should be remembered that about 1% of the total population is blind, and that more than the 5% of the total population has grave vision problems.

Unfortunately, in large cities served by multiple bus services, the problems for the visually impaired people do not stop here. In effect, these people, and particularly people who have lost vision, once the appropriate bus stop has been identified by the user, must be capable of signaling said bus, and be aware his call is being attended to and that the correct bus is approaching, distinguishing the particular bus he intends to board from the many others circulating in the same street and maybe also stopping at the same bus stop, but leading to diverse destinations.

At the same time, under the actual state of the art, the bus driver has no possibility of learning with the due anticipation that he is being requested at a determined bus stop by a handicapped person, and further he has no way to let this person know his call has been received and it is being acknowledged, thus proceeding to the bus stop.

When the instant invention is implemented in any given city, the user of one of the portable devices is able to perform all and any of the above mentioned functions, namely: to identify a given bus stop served by the bus line he intends to board; to be able to call the incoming vehicle of this bus line with the necessary anticipation; to learn his request has been received and it is being acknowledged; to be able to learn that the vehicle is approaching said bus stop, and to reset the signals in order to allow the following user to perform the same tasks.

OBJECTS OF THE INVENTION

It is an object of this invention to allow the user to select the calling signal of a public transportation service, such as a bus line, by means of a keyboard or number pad of the user's portable. This user's portable will thus under command by the user, adopt the frequency and any other attribute of a give first link signal of a limited range, achieving this through an emitting means of said device, capable of interrogating the several nearby bus stops of the public transportation network, and to identify the one being served by this selected bus line.

It is also an object of this invention that each one of the public transportation bus stops has a device which includes a receiving means capable of receiving said first interrogation link signal, which will be activated only when it captures and validates a first link signal corresponding to the frequency, and/or any other attribute, assigned to a determined bus transportation line or service, serving said bus stop. When said bus stop receiving means are activated, they energize a transmitter means which sends a second link signal, characteristic for this same bus line, with a determined range. This second signal can be captured on one hand by a receiver installed in the vehicle when said bus is nearing said bus stop, and on the other hand by the receiver belonging to the user, indicating the user about the proximity of said bus to the bus stop, and that his call is being attended to by the bus driver. This last signal will remain active until the vehicle leaves said bus stop, carrying the user on board. Simultaneously, a transmitting means in the bus stop will emit a third link signal, with a very short range.

It is still another object of this invention that when the disabled person arrives in front of the selected bus stop, a receiver in the user's portable will capture this third signal issued by the bus stop, indicating to the user arrival at the predetermined bus stop.

It is a further object of this invention, that the public transportation means, when it nears sufficiently the bus stop and receives said second link signal, it emits a fourth link signal which indicates to the user the arrival at the bus stop of said bus.

It is another object of this invention that the device on board the transportation means emits a fifth link signal capable to deactivate automatically the second link signal, once the bus leaves the bus stop.

It is still another object of this invention, that the visually impaired user or the disabled person may select manually the frequency of the first link signal to be emitted by the user's portable means, between a series of frequencies which respond to the totality of the bus lines serving a same city, including its surroundings. The user can delete said frequency and reprogram the device with other frequencies. It may be also possible to program a series of calls of several frequencies in a cyclic pattern. Moreover, even though the user is actually selecting frequency values, it is most probable that said frequency values are unknown to the user, and said frequencies are selected by entering a code in the keyboard or pad of the portable device.

It is a final object of this invention an emitting means placed upon the bus stop and capable of being received by the user's portable means, which emits an audible signal upon the reception of this last signal with an audible variable frequency as a function of the proximity of the user to said bus stop.

SUMMARY OF THE INVENTION

The system of the invention for selecting and signalling a public transportation conveyance to stop, and to detect the stopping place of said conveyance, particularly for handicapped people, more particularly still, for people with visual incapacities, comprises a first plurality of user portables;

a second plurality of bus stop stations, each installed at a different bus stop serving the public transportation network in a given city; and a third plurality of bus units installed respectively on each of said conveyances.

Each of the user's portables is provided with at least a sending means capable of emitting a first link signal indicative that an undetermined user seeks to contact a determined transportation line or service the system can include selection means for the attributes of said first link signal indicative of said particular transportation line, capable to initiate the emission of first link signal; a first receiver means for a second link signal emitted by a device belonging to said bus stop means, indicative of the reception of the first link signal by the nearest bus stop means of said particular transportation line; a second receiver means for a third link signal, having a much shorter range compared with the first and second link signals, issued by this same bus stop means and capable of indicating to the user the proximity of said bus stop; a third receiver means for a fourth link signal issued by the device installed on said public transportation means, capable to indicate to the user that said second link signal has been received by the bus and that said bus is nearing said bus stop; means capable to generate corresponding sensorial signals for the user when said second, third and fourth link signals are received by the user's portable means; means to maintain the emission of said first link signal until said fourth link signal has been received by the user's portable means; and an energy accumulator such as a dry cell or battery capable of feeding power to said emitting means, said receiving means and said means belonging to the user's portable means. Each of said bus stop units has at least, a first emission means capable to send said second link signal; a second emitting means capable to send said third link signal; a first receiver means for said first link signal capable to only validate signals with the determined attributes indicative of the particular bus line and to initiate the issue of said second and third link signals; a second receiver means for a fifth link signal issued by the bus means indicative that the passenger has boarded the vehicle and means capable of maintaining the emission of said second and third link signals, and a power source capable to provide power to said emission and receiver means.

Each of the bus units has at least corresponding emission means for said fourth and fifth link signals, a receptor for said second link signal capable of recognizing the attributes indicative of the particular bus line to which said bus belongs; means capable of generating at least an audible signal for the bus driver and the order to emit the fourth link signal when said receiving means receives and validates said second link signal; and means capable of sending said fifth link signal; and electric leads to be connected to the bus accumulator or battery for the power supply to the bus unit.

In other embodiments of this same invention the sending means in each user's portable means, said first and second emitting means in each bus stop unit and said first and second emitting means of each bus unit, are capable of sending link signals of different frequencies, and also having different frequencies for each bus line. Each frequency can be the same for each particular bus line. Each receiver can be tuned according to the frequency of the link signal which it intends to receive. These receivers can be capable of demodulating the received signals. The attributes pertaining to a particular bus line can be determined by the modulating and demodulated signals.

All the receivers of this arrangement according to the invention have tuning leads. In this way they may be preset to the frequency of the signal to be received. The receivers installed in the bus stops and in the vehicles are tuned only when they are changed from one bus line to another, or for maintenance purposes. The receivers in the user's portable means, if the attribute of the link signal that varies is the frequency of the link signals, must be capable of tuning by themselves automatically each time the user enters the code belonging to another bus line.

Assuming there is a visually impaired user wishing to travel in a vehicle of a determined public transportation line or service, while being in the street, that is outdoors, and supposing the selected bus line service is the line "132". In this case in order to issue the call signal an entry must first be made in the numerical pad or keyboard of the user's portable according to this invention, the number "1", followed by a "3" and then a "2". But the user's portable cannot know how many digits the call signal for this particular service line may be. Hence one must at the end of this numerical string enter the symbol "#" if the key pad is of the telephone kind, or an "ENTER".

Also, it could be the case that the street has a double circulation, with the traffic running in both directions and a further digit or symbol must be entered indicating the direction of the traffic of the bus to be taken. From this moment onwards the signals issue automatically a first link signal with specific attributes to be solely detected and validated by the receivers at the bus stops of the bus line "132", in the chosen direction or traffic circulation sense. This first link signal can be of a continuous transmission nature, but in order to economize on the consumption of the battery or power source of the user's portable, this can be a pulse signal. Also, the receiver in this same user's portable remains in the receiving mode until it received a second link signal coming from a bus stop which has detected the first link signal, while the other two receivers, or the same receiver but decoding different attributes of the carrier wave, remain only sensitive to receive respectively a third link signal coming from this same bus stop but having a very short range, e.g. 5 meters, and a fourth link signal coming from a vehicle of this same bus line. The third and fourth link signal has also their own attributes indicative of the selected bus service line and of the nature of said signal.

The user keeps on walking on the sidewalk until he reaches a range of e.g. 50 meters from one of the selected bus service stops. In this example, the bus stop for the bus line "132". At this distance the receiver on the bus stop is capable to receive and to acknowledge said signal emission.

This enables an emitting device of the bus stop to send the second link signal, with a range of e.g. 70 meters. This signal has the specific attributes to be recognized as a call signal for this particular bus line (132). The receiver on the user's portable is then capable of receiving this second link signal, and it emits a sensorial signal for the user (an audio or vibration signal) which will be maintained in a continuous or pulsed form as long as the user keeps on walking towards said bus stop, and if the user fails to perceiving this output it means he is walking away from bus stop.

Assuming the user reaches or is near the bus stop, when he is at e.g. 5 meters from said stop, his user's portable will detect the third link signal, and this will result in the issue of a sensorial signal which is different from the former signal. By this the user will know he has reached the desired bus stop location.

In other more complex constructions of the user's portable means of this same invention, the strength or input level for the second and third link signals may be detected, and the sensorial signals may be modulated with a change in their tone in response to said changing levels, which will allow the user to learn exactly in which direction he is supposed to walk in order to reach the desired bus stop.

The user, by means of his number pad or keyboard, may now interrupt the transmission of the first link signal. In some constructions of this invention, this can be performed automatically, for example by canceling the sensorial signal corresponding to the detection of the second link signal upon receipt of the third link signal, and canceling the sensorial signal corresponding to this second link signal after a short time, while at the same time interrupting the emission of the first link signal. Another way to obtain this result is to perform the above while receiving the fourth link signal, as explained below.

Supposing that a bus pertaining to the selected bus service line comes within the range of the second link signal issued by the bus stop, a receiver set installed on said vehicle, capable only to capture said specific signal given to said particular bus service line, will recognize the link signal and will emit an acoustic or luminous signal to the driver, thus letting him learn that a disabled person has requested his services at the nearest incoming bus stop, letting him take the necessary provisions. At the same time this device will issue a signal to said user. This is the fourth link signal, and when the user's portable captures this fourth signal, it emits a new acoustical signal to the user, in order to let him know he must get ready to board the vehicle. This same event may be used to short the emission of the first link signal.

Last, when the vehicle leaves the bus stop, carrying the user on board, the driver by means of a switch or the like, and possibly a time element or timer, will emit a fifth link signal of a very short duration. When this fifth link signal is captured by the bus stop receiver, it will interrupt the second link signal emitted by said same bus stop. In this way the means arrangement of this invention is left ready in waiting for the next user.

The above-mentioned working of this invention will not be perturbed through the interference between different users making use of their devices at the same time. The short range of the link signals allows for a particular user to relate only with a particular bus stop served by a particular bus line service, and to a determined vehicle belonging to this line. The users at different bus stops may never interfere their corresponding signals, since they belong to different bus services, having different signal attributes.

If two or more nearby or proximate users wish to board vehicles of a given line, their respective first signals will produce the same effect on the bus stop receivers, independently of which signal has first reached said bus stop receiver. The acknowledgements from the bus stop as well as from the vehicle transmitter will reach all the user's portables.

If instead, proximate users wish to board vehicles serving different lines, their respective emissions, i.e. the first link signal from each user's transmitter since they would have different attributes and/or frequencies would not interfere. This would be the same for the second, third fourth and fifth link signals.

SPECIFIC DESCRIPTION

Figure 1:
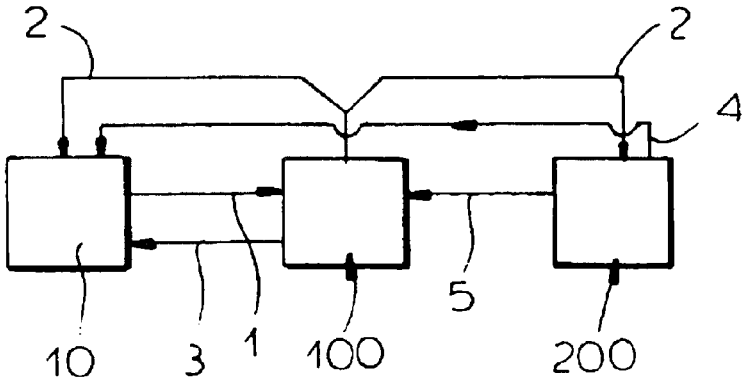
FIG. 1 is a block diagram with the different devices and basic relationship according to this invention.

In the drawing the reference numeral 10 represents the user's portable or device, the device or unit of a bus stop being shown at 100, while the means or unit installed on the vehicle or bus is shown at 200.

From the portable 10, a determined code is selected which corresponds to a link signal of a unique frequency, and this unit 10 emits or sends this link signal which is indicated by reference numeral 1. This signal 1 is the "first link signal", and is the signal sent by the user to interrogate the receivers placed at the bus stops 100.

This means 10 consists in a device having a key pad or keyboard 11 user friendly for people with poor or no vision, which allows them to enter in the transmitting means 10 the unique or single frequency. This unique frequency is emitted as a radio signal, or an infrared signal, corresponding to a determined bus line service allocated with this unique frequency. If the user wishes to contact the bus stop served by another bus line, different from the former, then he must enter another code with its unique frequency. Logically, the receiver means of this signal 1 placed in the bus stop 100 must be compatible with the nature of this first link signal 1. The suggested range for this first link signal 1 is about 50 meters, since a greater range may interfere with other receivers of the same line, and of this same frequency, placed at different bus stops.

Also, and admitting that there may be a street with a dual circulation sense, that is the traffic driving in opposed directions, there we may be a bus stop for this same bus service line placed on opposite sidewalks, the one more or less facing the other, and of course within said 50 m. range. In this case there would be a signal frequency for a signal 1 for one direction of travel and another frequency for the opposite direction. For instance, as said before, if the selected bus service corresponds to the line service "132", then the call signal to be entered into the key pad of 10 to interrogate the bus stop 100 for traveling in one direction would be <132#1>, while if the user wishes to travel in the opposite direction, then the call code would be <132#2>. Obviously the visually impaired people must be aware on which sidewalk they stand, in order not to cross the street inadvertently.

Figure 2A:
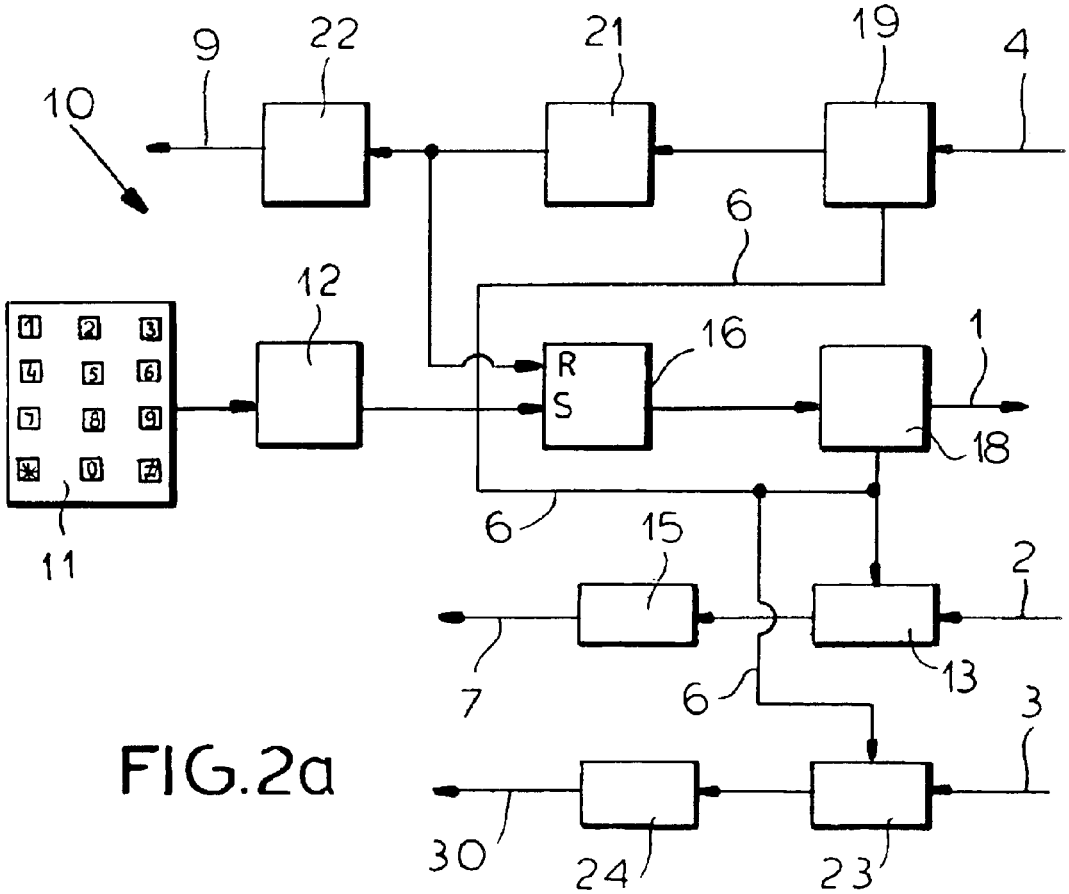
FIG. 2*a* is a block diagram detailing the functions of the user's portable.

The output of the key pad 11 of FIG. 2*a* is connected to an encoder-decoder 12, which decodes the output of the code entered at 11 which are recodes a binary sequence (of ONE and CERO) which will be interpreted by the emitting and receiver circuits as a frequency of emission and reception 6, displaced from one another in order to differentiate them. Any one of these sequences will be interpreted as a pulse arriving at the input set "S" of a flip-flop circuit RS 16, therefore the output will remain in active status until at the input a reset signal R from the flip-flop appears.

The signal 6 will then reach the frequency selection leads of the emitter 18 of the first signal 1 in order to tune it to the frequency of the selected bus line service.

All the receivers of the arrangement according to this invention have tuner leads. In this way they can be adequate to the frequency of the signal they are intended to receive.

Figure 2B:
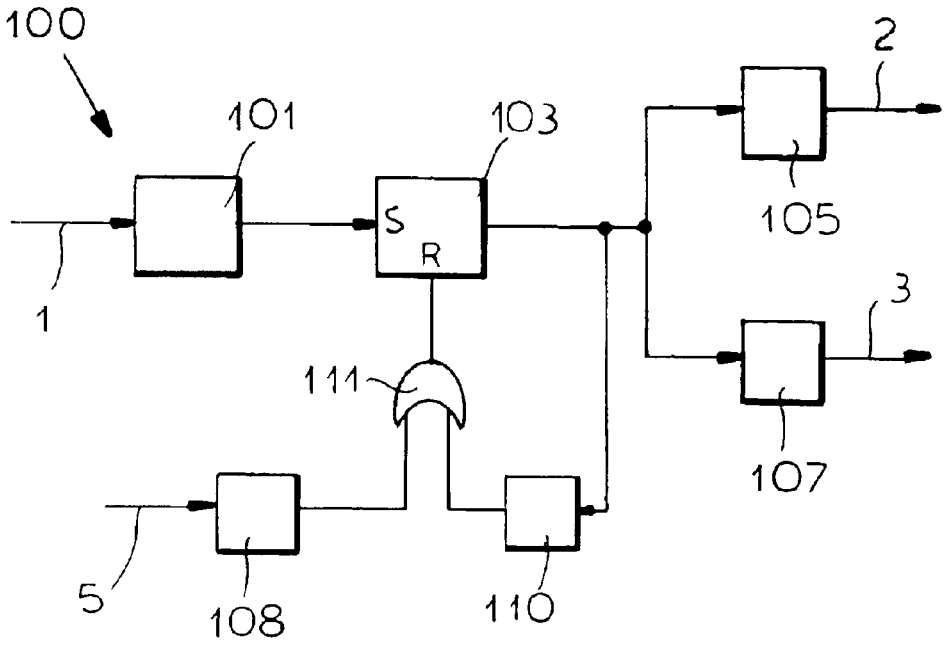
FIG. 2*b* is a block diagram detailing the functions of bus stop unit.

Once the link signal 1 has been received and recognized as a proper signal by the receiver 101 of FIG. 2*b* installed at the bus stop 100, this receiver means emits an outlet pulse which enters into input S of a flip-flop circuit 103, whose output will remain active until a pulse appears at its input R.

The outlet will then reach the enabling input of the two emitting circuits 105, 107 of the second link signal 2 and of the third link signal 3. On the other hand, and optionally, the output signal from 103 reaches the input of a timer 110 which will emit a pulse that will pass through the gate OR 111 to produce the reset of 103 after a lapse of time (for example, 20 minutes, which an estimated lapse between two consecutive arrivals of buses from the same line at the bus stop), but the reposition will normally reach before this, through a signal—fifth link signal—coming from the arriving vehicle at the bus stop. In this way, if the bus stop did not capture the fifth signal or this fifth signal fails to be sent by a forgetful drivers the bus stop after this time limit will not request further incoming buses to stop.

Signal 2 is received by a receiver 13 of the user's portable, and after its validation it passes unto a sensorial generating means 15, which most preferably is the generator of an acoustic signal, but of course any other signal may be used, such as vibratory outputs, etc. This same means emits for a very short lapse of time an acoustic acknowledgement signal 7. This is needed in order to allow the user to know that the bus stop 100 has been interrogated, by his signal, that this signal has been validated and accepted, and that said bus stop issued the corresponding calling signal to the incoming appropriate vehicle.

Figure 2C:
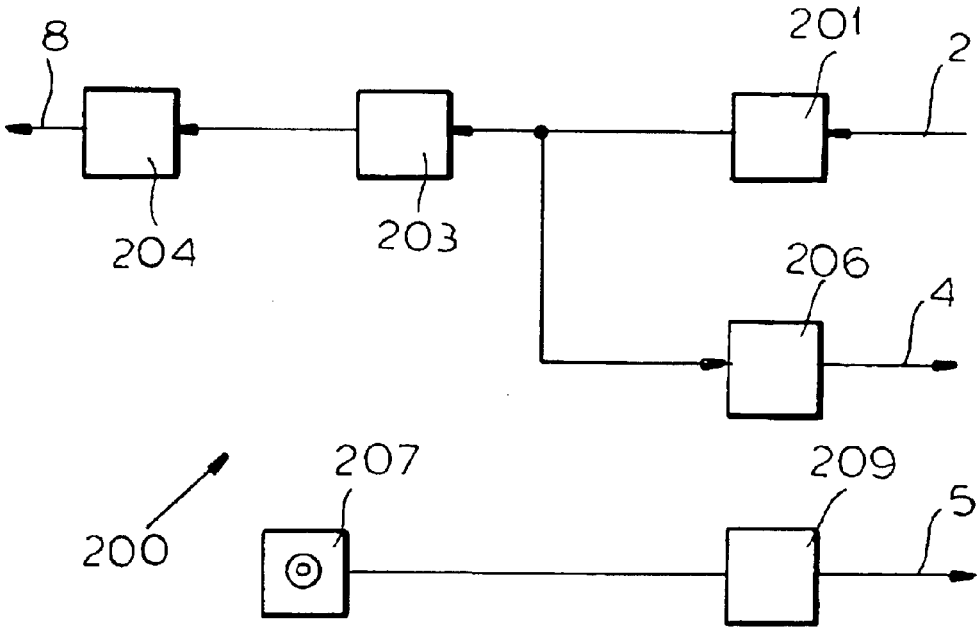
FIG. 2*c* is a block diagram detailing the functions of bus unit.

The second link signal 2, which ideally may have a range of about 70 meters, also reaches the means (unit) 200 installed on board of the vehicle, through its receiver 201 of FIG. 2*c*, and it is received and validated only if the vehicle belongs to the bus service line selected by the user, and if the vehicle is within the range of about 70 m. from the bus stop. The device (200) then performs two actions: through the timer 203 and the sensorial signal generator 204 it emits an audible or luminous signal 8 to the driver, or both, informing said driver that a disabled person has requested to board his vehicle; it also reaches the emitting means 206 which emits a fourth link signal 4 which shall be received by the user's portable means 10 through its receiver 19 which, employing a timer 21 will emit an audible signal 9 (different from the audible signal of proximity of the vehicle) through the generator 22 letting the user know that the awaited conveyance mean is near and nearing and that the conveyance (bus) has received the call signal. This same output signal 21 will reset the flip-flop 16 to its inactivity state, that is, the first signal 1 will be interrupted; last, when the vehicle has on board the user, said vehicle emits a link signal 5 through the emitting circuit 209 activated by the driver by means of the switch 207, which leads the reset of the second link signal 2 and the third link signal 3 at the bus stop 100 as emitted by said bus stop 100. This is performed because the signal 5 is received at the bus stop through the receptor 108 which output, passing through the gate OR 111, arrives at the inlet of the reset R of the flip-flop 103 in order to sever the emission of the emitting circuits 105 and 107.

Coming back to the third link signal 3 indication of the proximity of the user to the bus stop 100, this third signal is received by the user's portable 10 through a receiver 23. This signal 3 most preferably has a very short range, for instance, 5 meters, and it may consist in an infrared link signal. This link signal 3 has as the sole purpose to generate an audible or vibratory signal 30, which will be the actual "proximity signal" which gives notice to the user that he is located in front of or very near the bus stop, within a very short distance, in order to allow him the search for said bus stop in total confidence. This signal 3 may be associated to a timer 24, which limits its duration or time lapse, once it has entered into the receiver 11.

It is evident for the people versed in this art that the circuit construction of the block diagrams above explained and illustrated can be performed in several different ways, including with respects to the emitting and receiving circuits, as well as for the rest of the electronics. In reference to the latter, making use of non integrated elements, such as transistors, including integrated circuits of low integration level, such as flip-flop integrated circuits, monostable circuits, gates of different kinds, etc. of the several logical families (e.g. CMOS), up to circuits with a high integration, such as microprocessors and its parts thereof (e.g. RAM and ROM memories, entrance/outlet gates, etc). To these it should be added functional variations, such as timers which save on the power source consumption in the user's portable. The variations which arise from the compromise of making use of several different frequencies, one for each public transportation line service, as well as one for each of the link signals, which are five, indicates that the band width employed in a city with this arrangement would be quite ample (such as in the give example), or instead it could make use of one or very few frequencies, which would also allow to reduce only to two the number of receivers and emitters for each device, which is a lesser number that in the herein depicted construction for the invention, but it would add several modulation and demodulation functions in order to law the arrangement to recognize and validate the several link signals employed by the different line services. In this last case the use of microprocessors and relatively complex software could be needed.

Thus, this invention can employ decoder/codifying means, maintaining the emission of said first link signal until the fourth link signal has been received in each user's portable, said timers and said means capable of generating a sensorial signal when said fourth link signal is received, in each user's portable means, is constituted by a microprocessor with its associated peripherals which interconnect, through its input/output gates, the keyboard or keypad leads for the frequency selection and validation of the emitter, of the tuning and outlet of said first, second and third receivers and the transducers for said means capable of generating sensorial signals to the user.

All these variations are foreseen in the course of the present invention, and they form part of it, but it has been judged more preferable to exemplify a more simple construction, such as the one given above, making use of different frequencies.

What is claimed is:

1. A system for selecting and signalling a public transportation conveyance to stop, and to detect the stopping place of said conveyance means to be used by a handicapped user comprising:

a first plurality of user's portables for each of the users;

a second plurality of bus stop units, each installed at a different bus stop serving a public transportation network in a given city;

and a third plurality of bus units, each installed on one of said public transportation conveyances, each of said user's portables being provided with:

at least a sending means capable of emitting a first link signal indicative that an undetermined user seeks to contact a determined transportation line or service;

selection means of attributes of said first link signal indicative of said particular transportation means line, capable to initiate the emission of first link signal;

a first receiver means for a second link signal emitted by a device belonging to said bus stop means, indicative of the reception of the first link signal by the nearest bus stop means of said particular transportation means line;

a second receiver means for a third link signal, having a much shorter range compared with the first and second link signals, issued by this same bus stop means and capable of indicating to the user the proximity of said bus stop;

a third receiver means for a fourth link signal issued by the device installed on said conveyance, capable to indicate to the user that said second link signal has been received by the bus and that said conveyance is nearing said bus stop;

means capable to generate corresponding sensorial signals for the user when said second, third and fourth link signals are received by the user's portable means;

means to maintain the emission of said first link signal until said fourth link signal has been received by the user's portable means; and an energy accumulator such a dry cell or battery capable to feeding power to said emitting mean, said receiving means and said means belonging to the user's portable means;

each of said bus stop units having at least;

a first emission means capable to send said second link signal;

a second emitting means capable to send said third link signal;

a first receiver means for said first link signal capable to only validate signals with the determined attributes indicative of the particular line and to initiate the issue of said second and third link signals;

a second receiver means for a fifth link signal issued by the bus unit indicative that the passenger has boarded the conveyance and means capable to maintain the emission of said second and third link signals, and a power source capable to provide power to said emission and receiver means;

each of said bus units having:

at least corresponding emission means for said fourth and fifth link signals, a receptor for said second link signal capable of recognizing the attributes indicative of the particular bus line to which said bus belongs;

means capable of generating at least an audible signal for the bus driver and the order to emit the fourth link signal when said receiving means receives and validates said second link signal;

means capable of sending said fifth link signal; and electric leads to be connected to the bus accumulator for the power supply to said bus units.

2. The system defined in claim 1 wherein the range of the emitter of said first link signal is of about 50 meters.

3. The system defined in claim 1 wherein the range of the emitter of said second link signal is of about 70 meters.

4. The system defined in claim 1 wherein the range of the emitter of said third link signal is of about 5 meters.

5. The system defined in claim 1 wherein the range of the emitter of said fourth link signal of about 50 meters.

6. The system defined in claim 1 wherein the range of the emitter of said fifth link signal is of about 50 meters.

7. The system defined in claim 1 wherein each user's portable comprises timers capable of limiting the time of emission of said audible and vibratory signals.

8. The system defined in claim 1 wherein each of said conveyances is provided with a timer capable of limiting the emission time for said driver's at least audible signal.

9. The system defined in claim 1, further comprising attribute selection means of the first link signal is the form of a keyboard or a keypad connected to an encoding/decoder whose output is connected to the frequency selection leads of said emitting means and to the tuning leads of said first, second and third receivers; said means capable of maintaining the emission of said first link signal until said fourth link signal has been received in the corresponding user's portable, by a flip-flop SR whose input S is connected to the outlet of said encoding/decoding means, and whose input R is connected to the outlet of a timer, also connected to the entry port of the generating means of a sensorial signal upon receipt of said fourth link signal, an output being connected to an entry port of validation for the emitting means of said first link signal.

10. The system defined in claim 9 wherein said encoding/decoder means is capable of maintaining the emission of said first link signal until said fourth link signal has been received in the corresponding user's portable means; said timer and said generating means of a sensorial signal upon receipt of said fourth link signal from the corresponding user's portable means, is constituted by a microprocessor with its associated peripheries, connecting said microprocessor through its entry and outlet gates, the leads of the keyboard or keypad for the frequency selection and validation of the emitting means, of the tuning and outlet of first, second and third receiving means, and the transducers of said means to generate said sensorial signals.

11. The system defined in claim 1 wherein said one emission means of each user's portable, said first and second emitting means of each bus stop units, and said first and second emitting means of each bus means capable of sending link signals of different frequencies, and different frequencies for each one of the transportation lines circulating through the transportation network of a same city, each receiver being tuned in accordance to the frequency of the link signal intended to be received.

12. The system defined in claim 1 wherein said one emission means of each user's portable, said first and second emitting means of each bus stop unit, and said first and second emitting means of each bus unit is capable of sending link signals modulated at different frequencies but with said frequencies being the same for each individual line, each receiver being tuned in accordance to the frequency of the link signal intended to be received, and said receiver means being capable of demodulating the received signals; the attributes indicative of each determined bus line service being placed in the modulating and demodulated signals.

* * * * *